United States Patent [19]

Hyde

[11] 4,419,075

[45] Dec. 6, 1983

[54] BLAST FURNACE STOVE WALL

[75] Inventor: Jack Hyde, Pittsburgh, Pa.

[73] Assignee: Koppers Company, Inc., Pittsburgh, Pa.

[21] Appl. No.: 322,744

[22] Filed: Nov. 19, 1981

[51] Int. Cl.[3] ..... C21B 9/00

[52] U.S. Cl. ..... 432/217; 52/410; 110/336; 432/218

[58] Field of Search ..... 432/217, 218; 52/249, 52/408, 410; 110/336

[56] References Cited

U.S. PATENT DOCUMENTS

| | | | |
|---|---|---|---|
| 1,663,773 | 3/1928 | Parker | 110/336 |
| 2,420,373 | 5/1947 | Hogberg | 432/217 |
| 2,591,723 | 4/1972 | Sampson | 110/336 |
| 3,528,647 | 9/1970 | Hyde | 432/217 |
| 3,550,918 | 12/1970 | Van Laar | 432/217 |
| 4,290,751 | 9/1981 | Malone et al. | 432/217 |

*Primary Examiner*—John J. Camby

*Attorney, Agent, or Firm*—Daniel J. Long; Herbert J. Zeh, Jr.

[57] ABSTRACT

An internal partitioning wall for a blast furnace stove in which a layer of insulating material is interposed between two layers of refractory material. Buttressing means such as integral, refractory ledges are provided at periodic vertical intervals from one layer of refractory material to the other. These refractory ledges protect the insulating layer from damage due to radially directed compressive forces found to exist in this wall and also reduce deterioration of this insulation due to sagging and vertical compression.

23 Claims, 3 Drawing Figures

BLAST FURNACE STOVE WALL

BACKGROUND OF THE INVENTION

1. Field of the Invention

The present invention relates to regenerative heaters and, in particular, to blast furnace stoves.

2. Description of the Prior Art

It is known that certain efficiencies may be obtained in the use of blast furnaces when the blast of air provided to such furnaces is preheated to a temperature in the approximate range of 1500° to 2450° F. The preheating of this air is conventionally accomplished in a refractory lined stove which is positioned adjacent to the blast furnace to which it provides the hot blast. These stoves are generally equipped with an interior, vertical wall which partitions the stove into a combustion chamber and a checker chamber containing checkerbrick. Hot gases formed in the combustion chamber flow upwardly over the wall and then downwardly through the checker chamber. After the checkerbricks have been sufficiently heated, the direction of the gas flow is reversed and air is passed first upwardly over the checkerbrick and then downwardly through the combustion chamber so as to preheat the air before it is discharged to the blast furnace.

The partitioning wall often consists of multiple layers of brick. Facing the combustion chamber is a layer of brick commonly known as the skin wall, and facing the checker chamber there is another layer of refractory brick which is commonly known as the breast wall. Interposed between the skin wall and the breast wall, a layer of insulating material is also often provided.

The above described operation of the stove may result in a condition where the temperature in the lower part of the combustion chamber exceeds 2500° F., while the temperature in the lower part of the checker chamber is only about 600 ° F. Under such conditions there is a significant temperature differential across the partitioning wall, and this temperature differential may result in a corresponding differential of expansion between bricks on opposite sides of the partitioning wall. Ordinarily, the expansion of bricks in the skin wall will be greater than that of the material in the intermediate insulating layer which will, itself, exceed that of bricks in the breast wall. This expansion differential will be likely to result in the partitioning wall being concavely deformed and in a radial movement of its bricks toward the checker chamber. As a consequence of this radial movement, the refractory bricks in the skin wall will tend to press the intermediate, insulating layer against the refractory bricks in the breast wall. Because the insulating layer is generally softer than the refractory bricks in the skin and breast wall, the insulating layer will tend to be crushed or otherwise damaged as a result of the above described movement in the partitioning wall. Additionally, it is also found that certain materials which may have particularly good insulating properties may also tend to sag or be vertically compressed by their own weight at the temperatures which occur inside a blast furnace stove. It is, therefore, the object of the present invention to provide a means for protecting the insulating layer of the partitioning wall from such damage and deterioration.

SUMMARY OF THE INVENTION

The present invention consists of a blast furnace stove partitioning wall which is resistant to deterioration resulting from high temperatures and temperature differentials from its one side to the other. Essentially, an interior insulating layer is interposed between the refractory skin wall and breast wall, and buttressing means, such as integral refractory ledges, project from one refractory layer and abut or nearly abut the other wall. These refractory ledges protect the insulating material from compression as a result of radial movement between the skin wall and breast wall. Additionally, these ledges provide intermediate support for the insulating material to reduce sagging or vertical compression of the material so as to permit the use of certain insulating materials having particularly good thermal conductivity properties but which normally have low compressive strengths. Also within the scope of the present invention is a blast furnace stove having a shell wall which is insulated and reinforced in the manner summarized above.

BRIEF DESCRIPTION OF THE DRAWINGS

The present invention is further described in the accompanying drawings in which.

DETAILED DESCRIPTION

Figure 1:
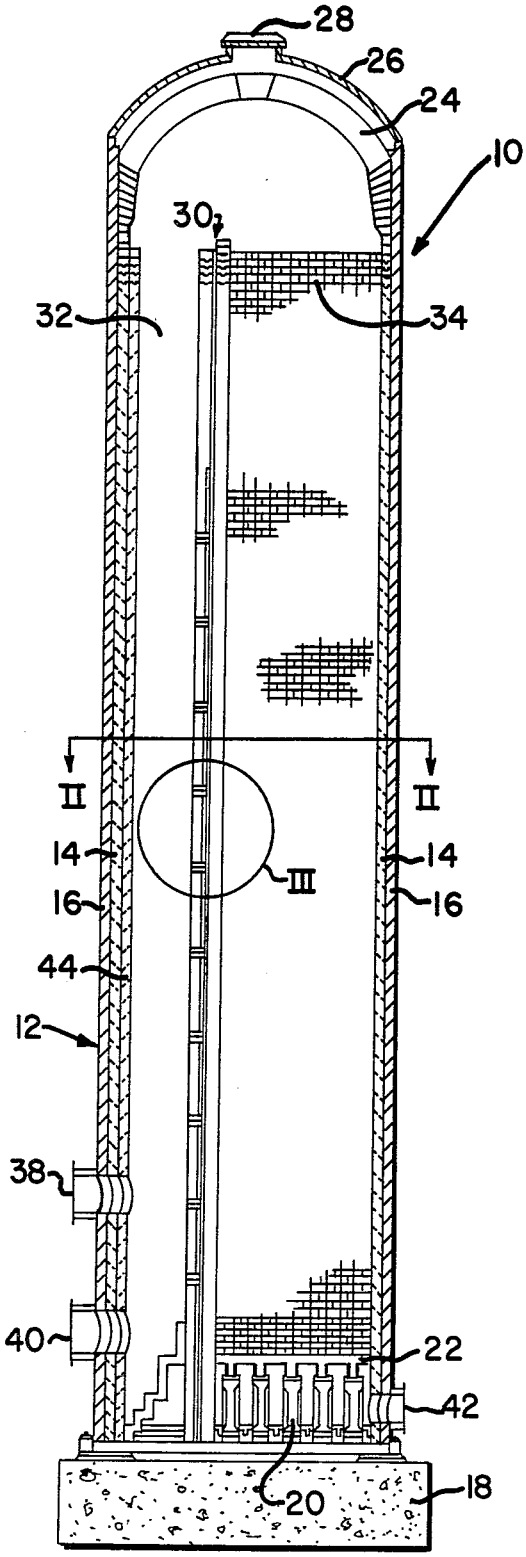
FIG. 1 is a schematic side elevational view of a blast furnace stove.
Figure 2:
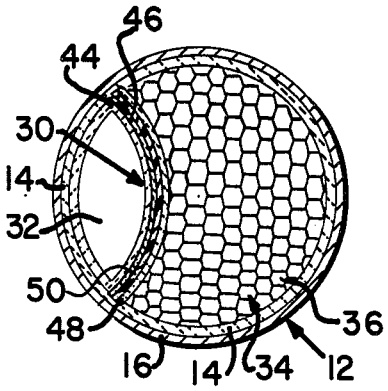
FIG. 2 is a cross-sectional view of a blast furnace stove as taken along line II—II in FIG. 1.

Referring to FIGS. 1 and 2, a blast furnace stove is shown generally at numeral 10. The stove 10 has an exterior shell 12 made up of a refractory shell wall 14 and an exterior steel jacket 16. The stove rests on a base 18 from where there extends a plurality of columns as at 20 which support a girder-grid system 22. At the top of the stove there is a refractory brick dome 24 over which there is a steel dome 26, the steel dome having a central manhole 28. The stove also has an internal, vertical partitioning wall, shown generally at numeral 30. The partitioning wall 30 divides the stove into a combustion chamber 32 and a checker chamber 34. This checker chamber is filled with layers of checkerbricks as at 36. The checkerbricks are supported by the girder-grid system 22.

The stove also has a hot blast outlet port 38 and a gas burner inlet port 40, that allow fluid flow between the stove exterior and the combustion chamber, and an off-gas outlet or cold blast inlet port 42 which allows fluid communication between the checker chamber and the exterior. It is noted that two or more separate ports may be employed instead of the single port 42 to exhaust off-gases and to intake cold air. Intimately mixed fuel and air from an external burner (not shown) are introduced through the gas burner inlet port 40 so as to effect the burning of the fuel in the combustion chamber 32. The resulting hot combustion gases are guided first upwardly, then over wall 30 through the space under dome 24 and then downwardly through the piles of heat absorbing checkerbrick in checker chamber 34. Finally, these combustion gases are exhausted through the port 42. When the checkerbricks have been sufficiently heated, the gas burner inlet port is closed and gas flow is reversed. That is, air to be preheated is fed through said port 42, first upwardly through the checker chamber where it absorbs heat from the checkerbricks, then over wall 30 and then downwardly through the combustion chamber until it leaves the stove at an elevated temperature through the hot blast outlet port 38.

Figure 3:
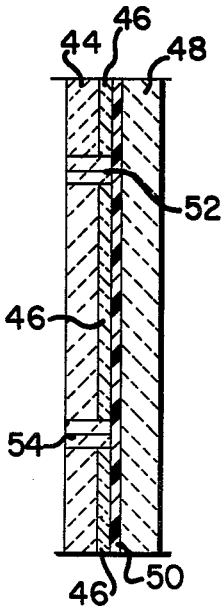
FIG. 3 shows the detail in circle III from FIG. 1 on an enlarged scale.

It will also be seen from FIG. 2 that the combustion chamber has a lining of refractory bricks known as the skin wall 44. This skin wall makes up part of the partitioning wall 30. Referring to FIG. 3, it will be seen that the partitioning wall 30 is comprised of this skin wall, as well as an intermediate insulating layer 46 preferably constructed of insulating block and a breast wall 48 on the checker side of the wall. The breast wall is constructed of refractory brick. There is, preferably, also a polystyrene slip joint 50 between the insulating layer and the breast wall and, in accordance with the present invention, a plurality of ledges as at 52 and 54 are positioned at periodic vertical intervals between the skin wall and the breast wall, in at least, the lower portion of the partitioning wall where the temperature differential is the greatest. As is illustrated, these ledges may consist of laterally disposed refractory bricks which are integral with the skin wall and which extend perpendicularly toward the breast wall so as to abut and be moveable on the slip joint 50.

Preferably the skin wall will be constructed of semi-silica fireclay, high alumina or silica refractories. The breast wall should be of a similar material in its upper area. Since, however, the temperature of the breast wall is lower in its lower and medial sections, lower grade materials may be used in those areas. While not illustrated, it may also be desirable to provide ceramic fiber packed expansion joints where the breast wall 48 is shown as interfacing with the shell wall 14 in FIG. 2. It may also be useful to incorporate such an expansion joint at the two points where the two curved lateral sides of the skin wall converge.

While also not shown in the drawings, it is a common practice to provide a layer of insulating material between the steel jacket 16 and the shell wall 14. A layer of insulation may also be interposed between the skin wall 44 and the shell wall 14. Although also not illustrated, it would, in accordance with the present invention, be useful in protecting such an insulating layer between the skin wall and the shell wall, to provide buttressing means at periodic vertical intervals between those walls. Such buttressing means may consist of a plurality of integral ledges which project from one of those refractory walls toward the other.

As was explained above, the temperature in the lower part of the combustion chamber may exceed, by a considerable degree, the temperature in the lower part of the checker chamber so that the bricks in the skin wall will tend to expand more than those in the insulating layer and still more than those in the cooler breast wall. Consequently, the skin wall expands both horizontally and vertically more than the breast wall. With partitioning walls heretofore known in the art, such radial movement of these bricks might result in the insulating layer being pressed by the skin wall against the breast wall so that the softer insulating layer might be crushed or otherwise damaged by the harder refractory brick in the skin and breast walls. It will be seen, however, that by means of the present invention, such damage to the insulating layer may be largely avoided since much of the radially directed pressure being exerted by the skin wall as a result of its thermal expansion will be borne by the harder breast wall instead of the softer insulating layer. It will also be seen that the ledges provide a means of intermediate support so as to avoid deterioration of the insulation layer resulting from sagging or vertical compression under its own weight at high temperatures.

Although the invention has been described with a certain degree of particularity, it is understood that the present disclosure has been made only as an example and that the scope of the invention is defined by what is hereafter claimed.

What is claimed is:

1. In a stove for preheating air to be fed to a blast furnace having a vertical shell lined internally with refractory brick work, a partitioning wall extending vertically from a stove base so as to divide said stove internally into a combustion chamber and a checker chamber containing checkerbrick, said partitioning wall having a vertical layer of insulating material interposed between two vertical layers of refractory material, an upper means for providing fluid communication between the combustion chamber and the checker chamber, closeable lower means for introducing a fuel and air mixture into the combustion chamber so as to form combustion gases, lower means for exhausting the combustion gases from the checker chamber after said combustion gases have passed over the checkerbrick, means for introducing air to be preheated into the checker chamber so as to produce preheated air, and lower means for withdrawing said preheated air from the combustion chamber, wherein the improvement comprises a plurality of buttressing means positioned at periodic vertical intervals between the two layers of refractory material in the partitioning wall.

2. The stove as defined in claim 1 wherein the buttressing means are integral, horizontal ledges inwardly projecting from one of the refractory layers toward said other refractory layer.

3. The stove as defined in claim 2 wherein the ledges abut, at their terminal ends, said other refractory layer.

4. The stove as defined in claim 2 wherein the ledges are terminally spaced from said other refractory layer.

5. The stove as defined in claim 2 wherein a slip joint is interposed between the terminal ends of the ledges and the other refractory layer.

6. A wall for internally partitioning a blast furnace stove into a combustion chamber and a checker chamber comprising:

(a) a first vertical layer of refractory material;

(b) a second vertical layer of refractory material disposed parallel to said first layer of refractory material and having at least two integral, spaced ledges, said ledges projecting inwardly toward the first layer of refractory materials; and (c) a vertical layer of insulating material interposed between said first and second layers of refractory material so as to abut, endwise, said inwardly projecting ledges, such that at least a part of any radially directed pressure resulting from a greater relative thermal expansion of one of said layers of refractory material will be borne by the other of said layers of refractory material.

7. The partitioning wall as defined in claim 6 wherein the ledges abut, at their terminal ends, said first vertical layer of refractory material.

8. The partitioning wall as defined in claim 6 wherein the ledges are terminally spaced from said first vertical layer of refractory material.

9. The partitioning wall as defined in claim 6 wherein a slip joint is interposed between the first layer of refractory material and the terminal ends of the ledges.

10. The partitioning wall as defined in claim 9 wherein the layer of insulating material laterally abuts said slip joint.

11. The partitioning wall as defined in claim 10 wherein the layer of insulating material laterally abuts the second vertical layer of refractory material.

12. The partitioning wall as defined in claim 6 wherein the insulating material consists of insulating block.

13. The partitioning wall as defined in claim 6 wherein the insulating material consists of insulating brick.

14. The partitioning wall as defined in claim 6 wherein the insulating material consists of a mixture of insulating block and insulating brick.

15. The partitioning wall as defined in claim 6 wherein the first and second vertical layer of refractory material face, respectively, the checker chamber and the combustion chamber.

16. In a stove for preheating air to be fed to a blast furnace having a vertical cylindrical shell lined internally with refractory brick work, a partitioning wall having a first and second end and extending vertically from a stove base so as to divide said stove internally into a combustion chamber and a checker chamber containing checker brick, said partitioning wall having a terminal vertical arcuate extension wall adjacent the shell and connecting its first end with its second end so as to laterally enclose said combustion chamber, a vertical layer of insulating material interposed between the shell and said arcuate extension wall, an upper means for providing fluid communication between the combustion chamber and the checker chamber, closeable lower means for introducing a fuel and air mixture into the combustion chamber so as to form combustion gases, lower means for exhausting the combustion gases from the checker chamber after said combustion gases have passed over the checkerbrick, means for introducing air to be preheated into the checker chamber so as to produce preheated air, and lower means for withdrawing said preheated air from the combustion chamber, wherein the improvement comprises a plurality of buttressing means positioned at periodic vertical intervals between said shell and said arcuate extension wall.

17. The stove as defined in claim 6 wherein the buttressing means are integral, horizontal ledges outwardly projecting from the arcuate extension wall toward the shell.

18. The stove as defined in claim 17 wherein the ledges abut, at their terminal ends, said shell.

19. The stove as defined in claim 17 wherein the ledges are terminally spaced from said shell.

20. The stove as defined in claim 17 wherein a slip joint is interposed between the terminal ends of the ledges and the shell.

21. The stove as defined in claim 1 or 16 wherein the insulating material consists of insulating block.

22. The stove as defined in claim 1 or 16 wherein the insulating material consists of insulating brick.

23. The stove as defined in claim 1 or 16 wherein the insulating material consists of a mixture of insulating block and insulating brick.

* * * * *